US006481838B1

(12) United States Patent
Brugue et al.

(10) Patent No.: US 6,481,838 B1
(45) Date of Patent: Nov. 19, 2002

(54) INK TUBE CONNECTION TO PRINTHEAD CARRIAGE COVER

(75) Inventors: Joaquim Brugue, Barcelona (ES); Lluis Hierro, Barcelona (ES); Macia Sole, Barcelona (ES); Alvaro Sanchez, Santiago (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/947,269

(22) Filed: Sep. 5, 2001

(51) Int. Cl.[7] ..... B41J 2/175
(52) U.S. Cl. ..... 347/85
(58) Field of Search ..... 347/84, 85, 86, 347/87, 37

(56) References Cited

U.S. PATENT DOCUMENTS

| | | | | |
|---|---|---|---|---|
| 6,003,981 A | | 12/1999 | Cameron et al. | 347/85 |
| 6,068,370 A | | 5/2000 | Miller et al. | 347/85 |
| 6,179,415 B1 | * | 1/2001 | Okazaki et al. | 347/86 |
| 6,190,007 B1 | | 2/2001 | Taylor et al. | 347/84 |
| 6,206,512 B1 | | 3/2001 | Gasso et al. | 347/85 |
| 6,247,802 B1 | | 6/2001 | Gasso | 347/85 |

FOREIGN PATENT DOCUMENTS

EP 0826504 A2 3/1998

* cited by examiner

*Primary Examiner*—Anh T. N. Vo

(57) ABSTRACT

A pen carriage for use in an inkjet printer of the type which includes a moveable scanning carriage, the carriage having at least one stall for reception of an inkjet pen having an upwardly directed fluid inlet which can be slidably connected to establish fluid communication of an inkjet pen on the carriage with an offboard fluid supply remote from the pen and a fluid delivery tube for connecting the supply to the pen. The carriage includes a base and a pen cover pivotally attached to the base, the tube having a length extending between pivotal connections of the cover to said base generally parallel to and radially spaced from the axis of pivotal connection of the cover to the base to permit and confine all twisting of the tube to the length between the connections. The cover also includes a fluid delivery passageway having a downwardly directed fluid delivery outlet opening toward and connected in fluid delivery relationship with the upwardly directed pen inlet when the cover is latched in closed position.

33 Claims, 8 Drawing Sheets

INK TUBE CONNECTION TO PRINTHEAD CARRIAGE COVER

BACKGROUND OF THE INVENTION AND PRIOR ART

The present invention relates to the art of computer driven printers and, more particularly, to large format color ink jet printers. Printers of this type have a printhead carriage which is mounted for reciprocal movement on the printer in a direction orthogonal to the direction of movement through the printer of the paper or other medium on which printing is to take place. The printer carriage of a color printer has at least one, and typically four, six or even more removable piezo-electric or thermal ink jet printheads, frequently referred to as pens, mounted thereon. Each pen may include a self contained supply of ink which, for large scale printers, is generally inadequate due to the large volumes of ink which are required as compared with the ink supply requirements of smaller desk top printers. Consequently, various means have been proposed for continuously or periodically refilling the carriage-borne pens with ink. These systems fall into two categories. The first comprises offboard or off-axis ink reservoirs which are continuously connected to the carriage-borne or onboard pens by flexible tubes. The second comprises a "take a gulp" system in which the printhead carriage is periodically moved to one end of its path of travel where it is then connected with off-axis ink reservoirs to fill the onboard pens.

Since the ink delivery tubes connected from offboard reservoirs to onboard pens continually flex, leakage and breakage of the ink supply tubes may be experienced. A reliable ink delivery system and guides for routing the ink delivery tubes from offboard ink supplies to the printhead carriage to minimize flexing, wear and damage of the ink tubes is shown in U.S. Pat. No. 6,206,512 B1 issued Mar. 27, 2001 to Gasso, et al. and owned by the assignee of the present invention, that disclosure being incorporated herein by reference. The moveable pen carriage shown in that patent has a number of installation stalls into which pens containing different colors of ink are inserted. These pens each have a downwardly opening fill port which slidably mates to establish fluid communication with an upwardly directed ink supply tube on the carriage and the pens are held in place in stalls in the carriage by a pivotal latch cover.

The use of replaceable carriage borne pens having upwardly opening fill ports to minimize ink dripping and leakage is desirable but the use of pens with upwardly opening fill ports requires the fluid connections of the ink supply tubes to the pens to be routed above the pens through the latch cover. The ink tubes are therefore necessarily twisted and flexed whenever the cover is pivotally opened or closed when installing and removing pens from their individual stalls thereby subjecting the tubes and connections to wear failure and eventual leakage. The present invention is directed to reliably and inexpensively solving this problem.

SUMMARY OF THE INVENTION

The present invention provides an inkjet pen carriage having a base defining a plurality of pen stalls, a pen cover pivotally attached to said base, said cover including fluid tubes having a length extending between pivotal connections of said cover to said base, said length extending generally parallel to an axis of pivotal connection of said cover to said base and at least one tube being spaced from said axis to permit twisting of said tubes in said length of said tubes about said axis, said tubes terminating in fluid delivery outlets for said pen stalls.

The present invention further provides an inkjet printer including a moveable carriage, at least one inkjet pen having an upwardly directed fluid inlet mounted on said carriage, a fluid reservoir remote from said pen and a fluid delivery tube for connecting said reservoir to said pen, said carriage including a base and a pen cover pivotally attached to said base, said tube having a length extending between pivotal connections of said cover to said base, said length extending generally parallel to an axis of pivotal connection of said cover to said base to permit twisting of said length of tube between said connections, said cover including a fluid delivery passageway having a fluid delivery outlet slidably connected in fluid delivery relationship with said pen inlet.

DESCRIPTION OF THE PREFERRED-EMBODIMENT

Figure 1:
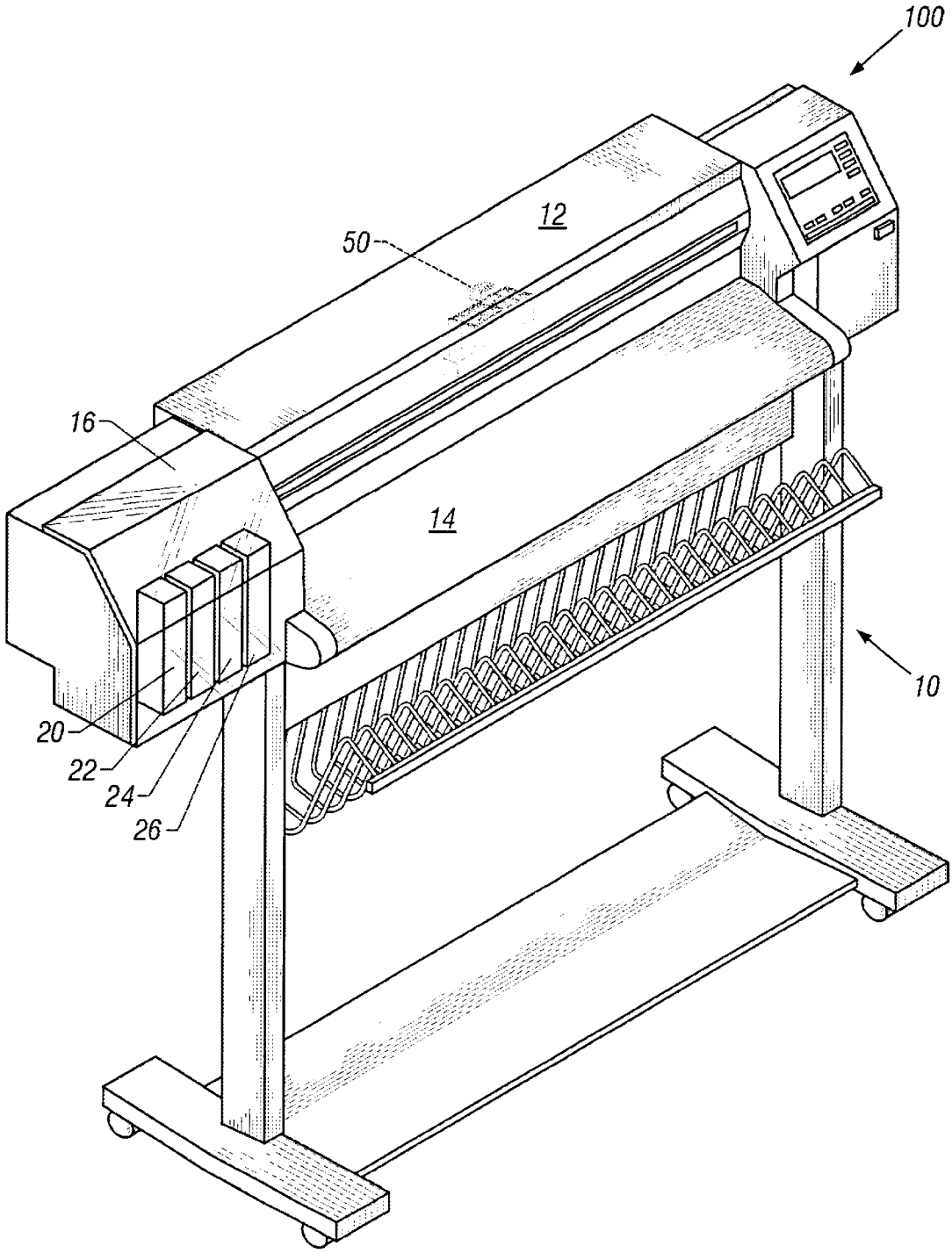
FIG. 1 is a perspective view of a large format printer in which the present invention may be used.

FIG. 1 shows a large format printer 10 of the type which includes a transversely movable pen carriage 50 which linearly travels inside a hinged cover 12 above a generally horizontally extending platen 14 over which printed media is discharged. At the left side of the platen is another hinged cover 16 which contains a number (four are shown) of offboard ink supply reservoirs 20, 22, 24, 26 which, through a number of flexible tubes, supply ink to inkjet pens 40 mounted in individual stalls formed in the moveable carriage 50. While each pen 40 is ordinarily connected to a single ink reservoir, in some instances it may be desirable to provide more or less ink reservoirs than pens so that, for increased use of, for example black ink, two black ink reservoirs may be connected by two separate black ink tubes to a single black ink pen or two or more black ink pens may be connected to a single black ink reservoir. A larger or smaller number of ink supply reservoirs can be provided.

Figure 4:
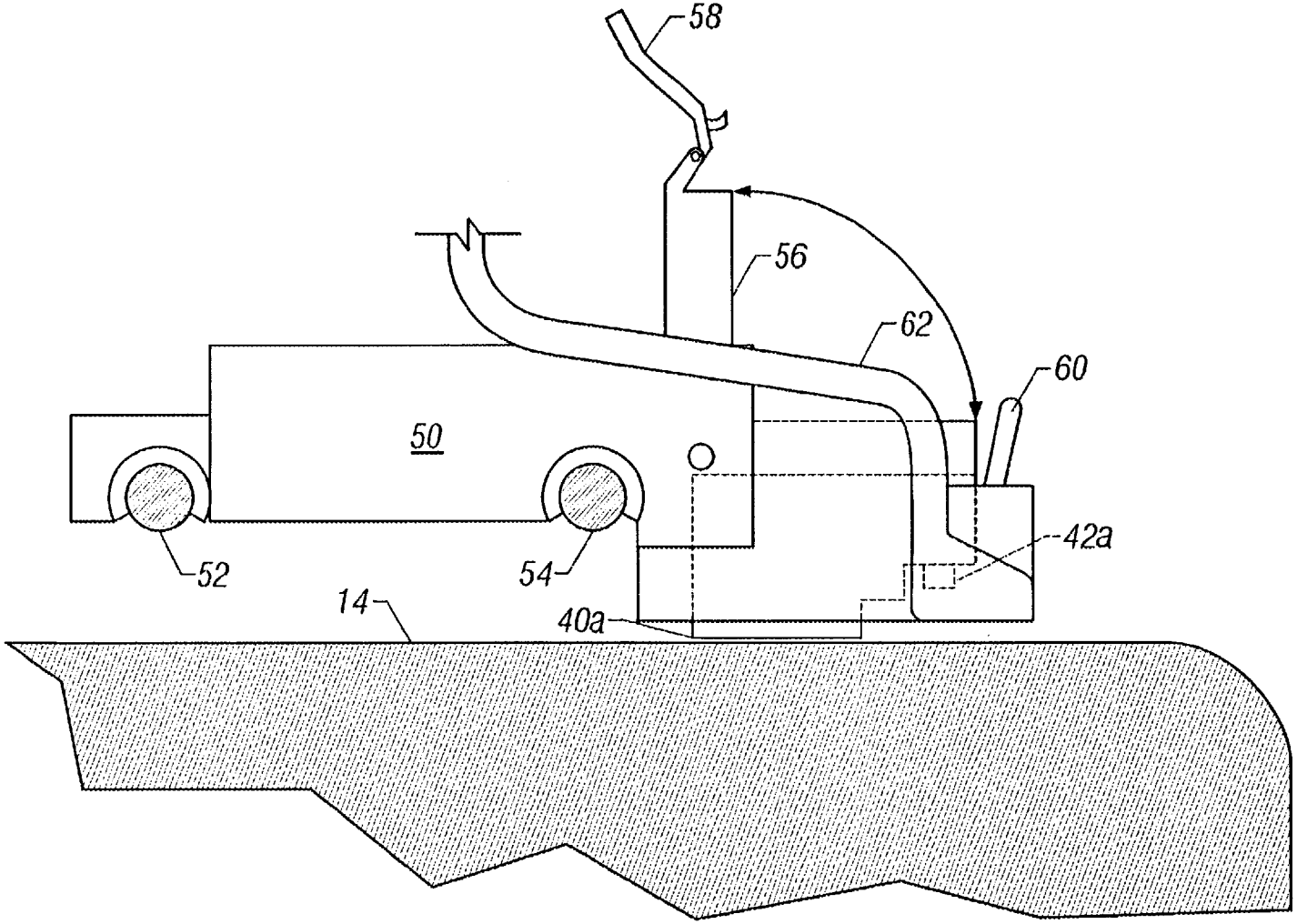
FIG. 4 (Prior Art)
FIG. 4 is a side elevation view of a prior art pen carriage having a pivotally connected latch cover for holding a plurality of down-connect pens supplied with ink from offboard ink supplies by flexible ink tubes.

The pen carriage 50 includes bearing supports 51 and typically is mounted on a pair of transversely extending slider rods or guides 52, 54 which in turn are rigidly mounted in the printer as seen in FIG. 4 depicting a prior art arrangement.

The ink delivery system which conveys ink from the various separate ink reservoirs 20, 22, 24, 26 at the left side of the printer through flexible ink tubes to the pens 40 on the carriage 50 may be a replaceable sub-system as described and claimed in the aforementioned U.S. Pat. No. 6,206,512. The ink delivery tubes are preferably made of a linear low density polyethylene and may be covered by a protective sheath of polypropylene or other material. Each of the various ink reservoirs 20, 22, 24, 26 is easily accessible from the front of the printer when the reservoir cover 16 (seen in FIG. 1) is open so that the reservoirs can be easily removed to be refilled or replaced with new reservoirs. As is known in the art, the reservoirs each contain a different base color of ink such as cyan, magenta and yellow or black so that a high number of colors can be produced as desired during printing. A pen service station 100 may be provided at the right side of the printer at which the printhead carriage 50 may be parked for servicing such as wiping, spitting and priming of the pens.

Figure 5:
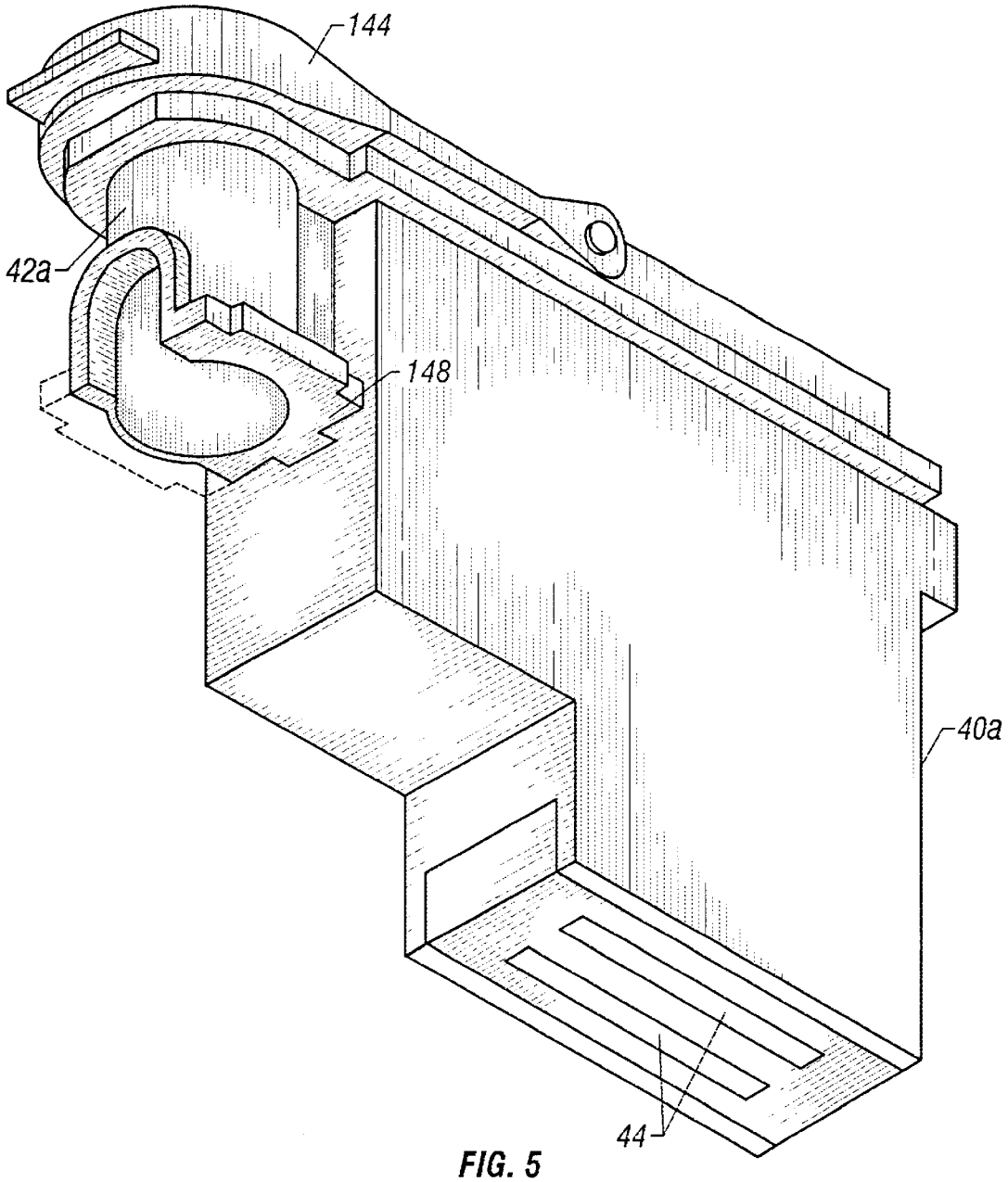
FIG. 5 (Prior Art)
FIG. 5 is a perspective view of a down-connect pen used in the prior art pen carriage of FIG. 4.

FIGS. 4 and 5, respectively, relate to perspective views of a prior art pen carriage and pen referred to as a down-connect pen 40*a*, having a downwardly opening or so-called down-connect fluid inlet port 42*a*. As seen in FIG. 4, the ink ejecting orifices of the pen are arranged in two spaced arrays 44 for downwardly ejecting ink onto the media to be printed. The carriage 50 also includes a hinged cover 56 at the top shown in solid lines in the open position and in phantom in the closed position in FIG. 4. A latch 58 on the cover 56 includes a hook which engages a bar 60 on the lower portion of the carriage for holding down the individual down-connect pens 40*a* in their stalls. When using down-connect pens, the ink delivery tubes are introduced to the lower front portion of the carriage through a rigid tube connector 62 and the carriage 50 has internal conduits having upwardly directed ends which receive the individual ink tubes therein and upwardly directed fluid connectors which mate with the down-connect fill ports 42*a* on the down-connect pens 40*a* to automatically form fluid transmitting connections when the cover downwardly urges the down-connect pens into engagement with the upwardly directed carriage connectors as is known in the art.

Figure 2:
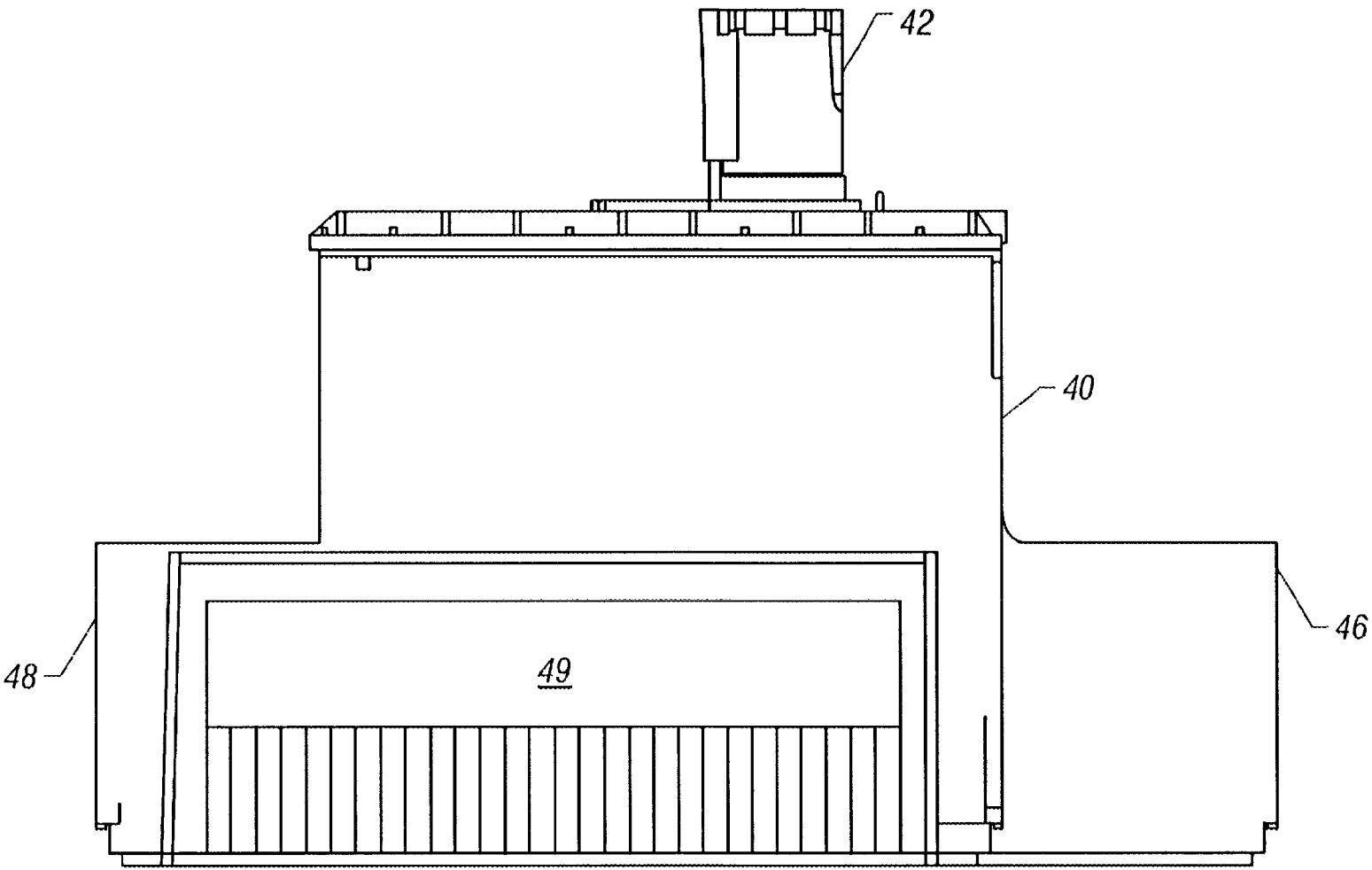
FIG. 2 is a perspective view of a pen having an upwardly directed fill tube.
Figure 3:
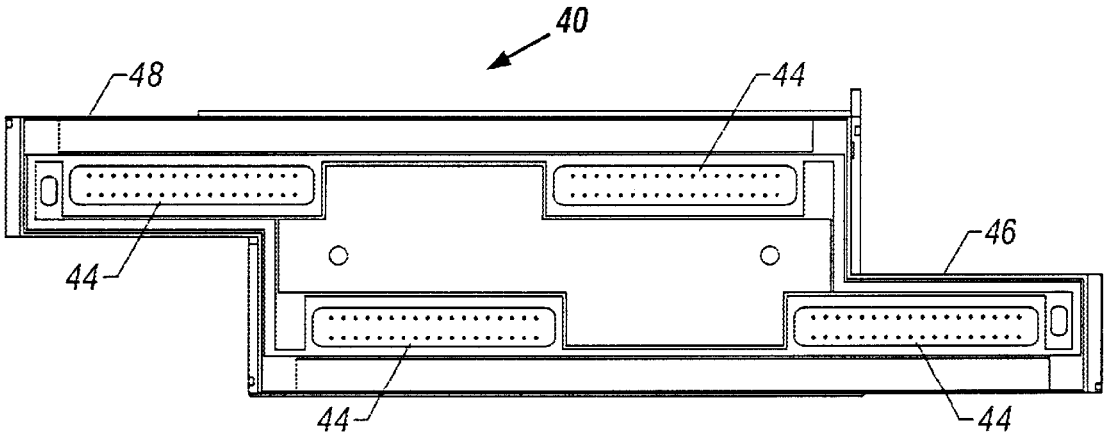
FIG. 3 is a bottom plan view of the pen of FIG. 2.
Figure 6:
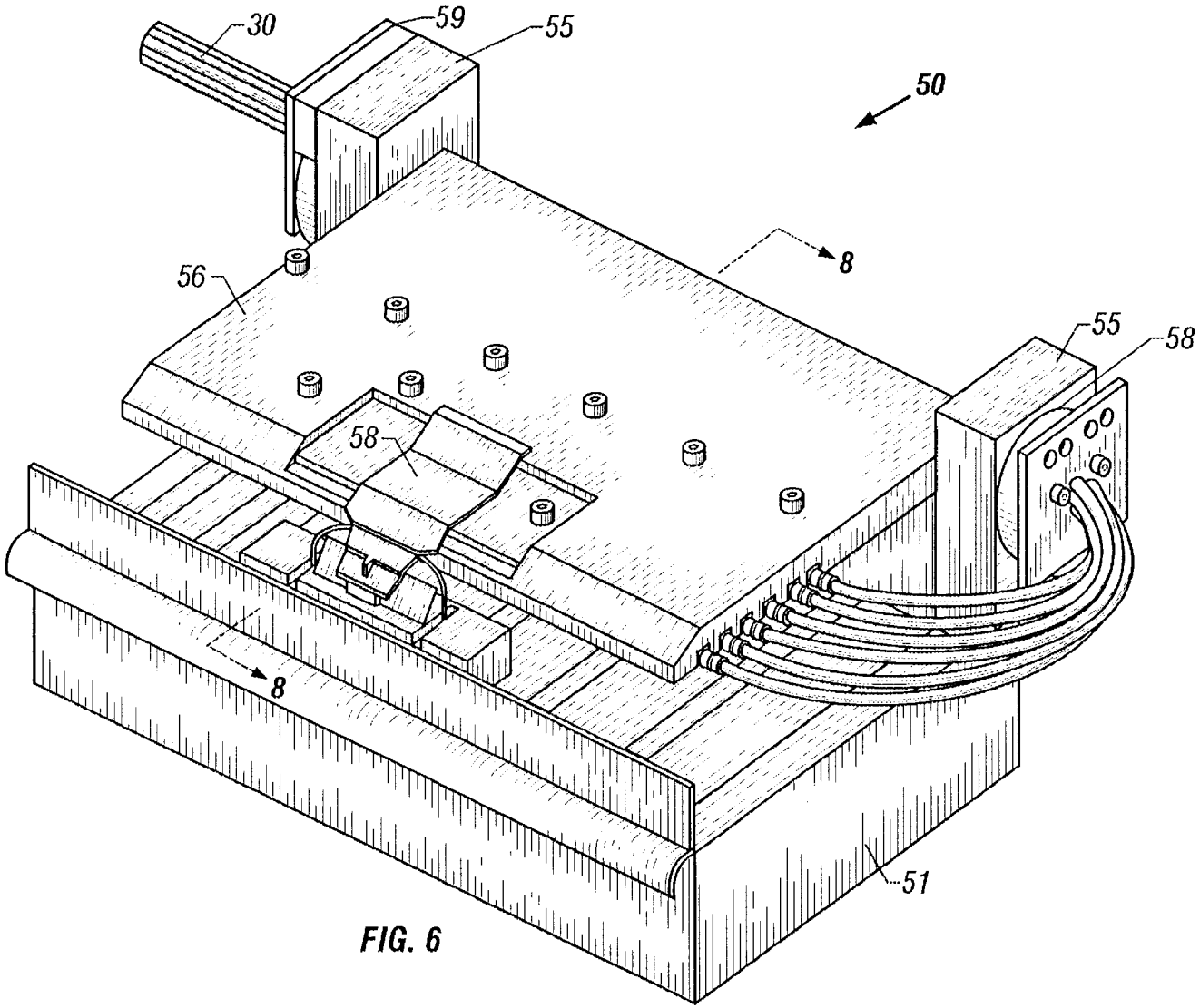
FIG. 6 is a perspective view from the right of a pen carriage pursuant to the invention.
Figure 7:
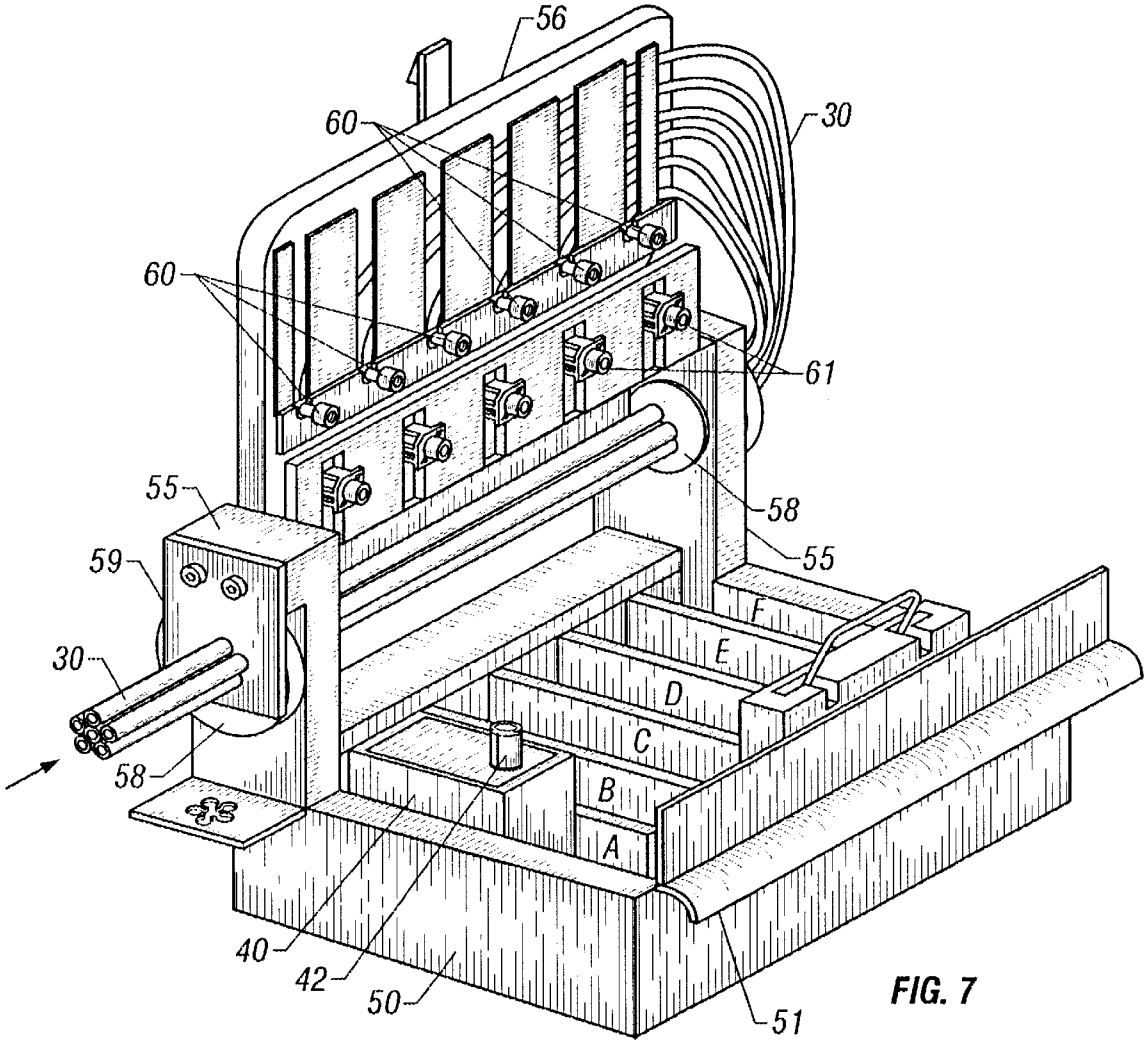
FIG. 7 is perspective view from the left of the pen carriage of FIG. 6 with the cover open and one up-connect pen installed therein.
Figure 8:
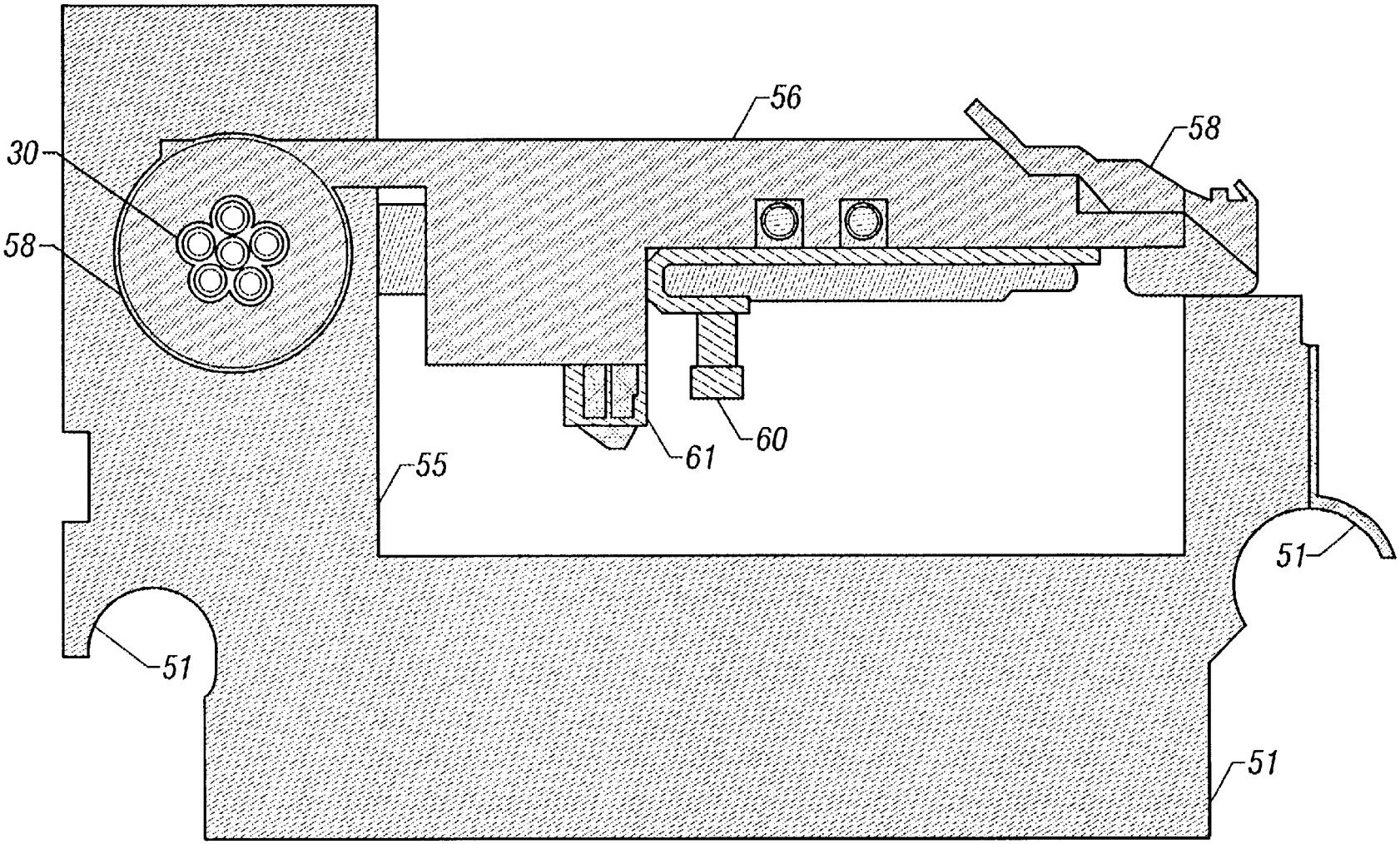
FIG. 8 is a vertical cross section view taken at line 8—8 in FIG. 6.

A pen carriage for holding individual pens 40 having up-connect fill ports 42 is desired since fluid leakage and spillage during pen replacement can be minimized thereby. Such a carriage is exemplified in FIGS. 6, 7 and 8. The carriage 50 has a lower base portion 51 of molded plastic or similar materials provided with slider bearings (not shown) or equivalents so that the carriage can be mounted for back and forth movement on the elongated carriage supports 52, 54. The base portion 51 of the carriage defines a plurality of individual side-by-side pen stalls A–F in which individual up-connect pens 40 may be received. One such pen of the type previously described with reference to FIG. 2 is shown in stall A in FIG. 7. The carriage 50 of the present invention is designed for use with so-called up-connect pens 40 as shown in FIG. 2 which each have an ink delivery fill port 42 which opens in an upward direction and can be compared with the down-connect pen 40*a* shown in FIG. 5. As is conventional, ink is ejected downwardly from microscopic orifices ordinarily arranged in rows 44 as seen on the lower surface of the pen 40 as shown in the prior art pen 40*a* seen in FIG. 5. The up-connect pens 40 shown in FIG. 2 are generally comprised of a plastic ink containing housing and may have laterally offset lower fore and aft sections 46, 48 seen in the bottom plan view of FIG. 3 each having orifice arrays 44 on the lower surface thereof. Resilient electrical interconnects 49 are provided on the opposite side surfaces of the pen for slidably engaging and forming electrical connection with mating electrical interconnects in the stalls in the carriage 50. As shown in FIGS. 6 and 7, the carriage 50 is illustrated with six stalls for receiving the individual pens and the up-connect fluid inlet ports 42 in the stalls are all preferably aligned so that substantially identically configured pens can be received in the stalls. Lockout means such as tabs on the pens and mating slots in the stalls can be provided to ensure that a particular stall will receive only a particularly configured pen such as magenta or black. Those skilled in the art will also appreciate that smaller or larger pen carriages can be constructed within the teachings of the invention and that each set of stalls may be configured to hold only similarly configured pens. Up-connect pens configured with laterally offset lower fore and aft portions 46, 48 as shown in FIG. 3 can thus be received in sets of fore and aft carriage stalls with the fore and aft orifice arrays of the pens being closely nested together to reduce space and weight.

The base portion 51 of the carriage includes a pair of upwardly extending spaced cover mounts 55 between which the pen cover 56 is pivotally supported. Cover bearings 58 affixed to the cover 56 are received in aligned apertures in the mounts 55 and rotate in the apertures as the cover 56 is opened and closed. A plate 59 affixed by any suitable means such as screws to the mount 55 is seen at the left in FIG. 7 and holds the tubes 30 stationary against twisting about the pivot axis of the latch cover 56. The tubes pass through the plate 59 and through a central aperture (not shown) in the left bearing 58 across the cover 56 to the right bearing 58 in which they are firmly affixed in position so that all twisting of the tubes about the axis of the cover is confined to the length of tubes between the plate 59 and the right bearing 58.

The ink delivery tubes 30 (six are shown in the illustrated embodiment) are arranged preferably with one in the center and five on a circle centered on the axis of rotation of the cover 56 and extend from an ink inlet side at the left as seen in FIG. 6 through the bearings 58 mounted in the mounts 55 to the right side of the cover where they make reverse bends before entering the main generally flat portion of the cover 56 through which they then pass to conduct ink to individual ink delivery outlets 60 in each of the pen stalls. The ink delivery outlets 60 are downwardly oriented when the cover is in the closed position for slidably mating with the up-connect inlets 42 of the individual pens received in the stalls to establish fluid communication between the outlets 60 and inlets 42. Pen pre-load plungers 61 are provided on the underside of cover 56 to hold the pens in proper position in their stalls when the cover is closed and latched. The cover 56 thus includes fluid passageways which may comprise the ink tubes 30 themselves continuously routed through the cover or functional equivalents such separate tubes in the cover having inlet ends to which the tubes 30 external to the cover can be connected, the tubes in the cover terminating in the outlets 60.

As will be understood from viewing FIG. 7 in conjunction with the above description of the invention, design of a pen carriage for use with up-connect pens 40 dictates that the tubes in the cover such as the fluid delivery tubes 30 have downwardly directed outlet ends and the external tubes 30 must therefore extend through or be connected to separate tubes in the pen hold down cover 56. Twisting and flexing of the individual ink tubes 30 must be minimized to avoid wear and fatigue breakage and resultant leaks while avoiding the complexity and attendant expense of complex rotary fluid joints and seals. Introduction of the tubes 30 axially of the pivot axis of the cover 56 and routing of the tubes 30 across the full width of the cover 56 before they make their reverse bend and pass through the cover 56 confines all twisting of the tubes 30 during opening and closing of the cover 56 to the axial length of the tubes 30 between the upstanding cover mounts 55. Wear and resulting tube failure is therefore minimized since axial flexing of the tubes does not take place in the carriage cover and the force required to open and close the cover is minimized due to the positioning of the length of tubes between the bearings around the axis of pivotal connection of the cover to the base of the carriage.

Although the presently preferred embodiments of the invention have been shown and described in detail, those skilled in the art will appreciate that various modifications may be made without departing from the spirit and scope of the invention which is defined in the appended claims.

What is claimed is:

1. An inkjet pen carriage comprising a base defining a plurality of pen stalls, a pen cover pivotally attached to said base, said carriage including fluid tubes having a length extending between pivotal connections of said cover to said base, said length extending generally parallel to an axis of pivotal connection of said cover to said base and at least one tube being spaced from said axis to permit twisting of said tubes in said length of said tubes about said axis, said tubes supported on said cover and terminating in fluid delivery outlets at said pen stalls.

2. The carriage of claim 1, wherein said base includes axially spaced cover mounts, said cover including bearings through which said tubes extend, said bearings being rotatably mounted in said mounts.

3. The carriage of claim 2, wherein a first one of said bearings is rotatable relative to said tubes at a first end of said length and said tubes are affixed to a second one of said bearings at a second end of said length.

4. The carriage of claim 3, wherein said tubes are affixed to said carriage proximate said first bearing.

5. The carriage of claim 4, wherein said tubes include a reverse bend between said second bearing and said outlets.

6. The carriage of claim 5, wherein said outlets open downwardly toward said stalls when said cover is in a closed position.

7. The carriage of claim 6, wherein said axis is generally horizontal.

8. The carriage of claim 7, wherein said tubes are arranged such that said length of at least some of said tubes is on a circle centered on said axis.

9. A fluid delivery system comprising the carriage of claim 1 in which each of said fluid delivery tubes has an extent external to said carriage and further including fluid inlet connectors at ends of each of said tubes remote from said carriage for connection to remote fluid supplies.

10. An inkjet pen carriage comprising a base defining at least one pen stall, a pen cover pivotally attached to said base, said carriage including at least one fluid tube having a length extending between spaced pivotal connections of said cover to said base, said length extending generally parallel to an axis of pivotal connection of said cover to said base to permit twisting of said length of between said connections, said cover including at least one fluid delivery passageway having a fluid delivery outlet directed toward said pen stall for delivering fluid from said tube to said outlet.

11. The carriage of claim 10, wherein said base includes axially spaced cover mounts, said cover including bearings through which said tube extends, said bearings being rotatably mounted in said mounts.

12. The carriage of claim 11, wherein said carriage includes a plurality of said stalls, tubes and outlets for each stall, said length of at least some of said tubes being generally parallel to and radially spaced from an axis of pivotal connection of said cover to said base.

13. The carriage of claim 12, wherein a first one of said bearings is rotatable around said tubes and said tubes are affixed to a second one of said bearings.

14. The carriage of claim 13, wherein said tubes are affixed to said carriage proximate said first one of said bearings.

15. The carriage of claim 14, wherein said tubes include a reverse bend between said second one of said bearings and said outlets.

16. The carriage of claim 15, wherein said outlets open downwardly when said cover is in a closed position.

17. The carriage of claim 14, wherein said tubes are arranged such that said length of at least some of said tubes is on a circle centered on said axis.

18. An inkjet pen carriage comprising a base defining a plurality of pen stalls, a pen cover pivotally attached to said base, said carriage including fluid tubes having a length extending between pivotal connections of said cover to said base generally parallel to and radially spaced from an axis of pivotal connection of said cover to said base to permit twisting of said tubes about said axis, said cover including fluid delivery passageways having fluid delivery outlets directed toward said pen stalls for conducting fluid from said tubes to said pen stalls when said cover is in closed position.

19. The carriage of claim 18, wherein said base includes axially spaced cover mounts, said cover including bearings through which said tubes extend, said bearings being rotatably mounted in said mounts.

20. The carriage of claim 19, wherein a first one of said bearings is rotatable around said tubes and said tubes are affixed to a second one of said bearings.

21. The carriage of claim 20, wherein said tubes are affixed to said carriage proximate said first bearing.

22. The carriage of claim 21, wherein said tubes include a reverse bend between said second bearing and said outlets.

23. The carriage of claim 22, wherein at least some of said outlets are arranged in a line parallel to said axis.

24. The carriage of claim 22, wherein said tubes are arranged such that said length is on a circle centered on said axis.

25. An inkjet printer comprising a moveable carriage, at least one inkjet pen having an upwardly directed fluid inlet mounted on said carriage, a fluid reservoir remote from said pen and a fluid delivery tube for connecting said reservoir to said pen, said carriage including a base and a pen cover pivotally attached to said base, said tube having a length extending between pivotal connections of said cover to said base, said length extending generally parallel to an axis of pivotal connection of said cover to said base to permit twisting of said length of tube between said connections, said cover including a fluid delivery passageway for conveying fluid from said tube to said pen, said passageway having a fluid delivery outlet slidably connected in fluid delivery relationship with said pen inlet.

26. The printer of claim 25, further comprising a plurality of said pens mounted in individual stalls in said base and a plurality of said tubes connected to deliver fluid to said pens.

27. The printer of claim 26, wherein said base includes axially spaced cover mounts, said cover including bearings through which said tubes extend, said bearings being rotatably mounted in said mounts.

28. The printer of claim 27, wherein a first one of said bearings is rotatable around said tubes and said tubes are affixed to a second one of said bearings.

29. The printer of claim 28, wherein said tubes are affixed to said carriage proximate said first bearing.

30. The printer of claim 29, wherein said tubes include a reverse bend between said second bearing and said outlets.

31. The printer of claim 30, wherein said outlets slidably connect with said pen inlets when said cover is moved to a closed position.

32. The printer of claim 31, wherein said axis is generally horizontal.

33. The printer of claim 32, wherein at least some of said tubes are arranged such that said length is on a circle centered on said axis.

* * * * *